US005123837A

United States Patent [19]

Farnham et al.

[11] Patent Number: 5,123,837

[45] Date of Patent: Jun. 23, 1992

[54] TORCH ASSEMBLY

[75] Inventors: Gilbert R. Farnham; Alonzo A. Burgin, III, both of Sycamore, Ill.

[73] Assignee: Cooper Industries, Inc., Houston, Tex.

[21] Appl. No.: 511,638

[22] Filed: Apr. 20, 1990

Related U.S. Application Data

[62] Division of Ser. No. 330,241, Mar. 29, 1989, abandoned.

[51] Int. Cl.[5] ..... F23Q 3/00

[52] U.S. Cl. ..... 431/258; 431/264; 431/255

[58] Field of Search ..... 431/254, 255, 258, 263, 431/264, 265, 266, 354, 355, 344; 60/39, 827

[56] References Cited

U.S. PATENT DOCUMENTS 3,475,110 10/1969 Suchowelec .
3,694,134 9/1972 Ross ..... 431/255
3,711,242 1/1973 Bowman .
3,736,093 5/1973 Bowman et al. .
3,802,828 4/1974 Mercer et al. ..... 431/255
3,865,137 2/1975 Chvatal .
3,891,195 6/1975 Mills, Jr. .
3,978,880 9/1976 Crown et al. .
4,332,550 6/1982 Baumann .
4,348,172 9/1982 Miller ..... 431/255
4,516,933 5/1985 Buzzi ..... 431/255
4,526,532 6/1985 Nelson ..... 431/255
4,597,732 7/1986 Yoshinaga ..... 431/255
4,804,324 2/1989 Yoshinaga ..... 431/255
4,881,894 11/1989 Chapin et al. ..... 431/255
4,954,098 9/1990 Nelson ..... 431/255

*Primary Examiner*—Carl D. Price
*Attorney, Agent, or Firm*—A. Triantaphyllis

[57] ABSTRACT

A valve is disclosed for regulating the flow of fuel from a fuel source containing fuel under pressure to a fuel consuming apparatus. The valve includes a valve body having a passage therethrough, a resilient element for regulating the flow of the fuel through the passage, and spring means for adjusting the compresion on the gasket. A torch is also disclosed. The torch includes a burner tube, an igniter mounted on the exterior of the tube and a housing for housing the igniter.

2 Claims, 4 Drawing Sheets

TORCH ASSEMBLY

This is a divisional of copending application Ser. No. 07/330,241 filed on Mar. 29, 1989, now abandoned.

TECHNICAL FIELD

The present invention relates to the field of valves, and more particularly, to a valve for regulating the flow of fuel from a fuel source to a fuel consuming apparatus such as a heating, brazing, cutting or welding torch. Still more particularly, the present invention relates to a self-adjusting valve that restricts and regulates the flow of fuel to the torch in response to changes in the pressure of the fuel in the fuel source or downstream of the point of restriction and regulation. The valve may be used in different ambient temperatures. Furthermore, the present invention relates to a torch that includes a housing for housing a torch igniter.

BACKGROUND OF THE INVENTION

Torches which burn liquified petroleum gas and valves for regulating the flow of said gas to the torch are well-known in the art. Examples of such torches and valves are disclosed in U.S. Pat. Nos. 3,736,093; 3,475,110; 3,978,880; 3,865,137; and 3,891,195.

The most commonly used torches utilize fuel gas available from a pressurized container wherein the fuel gas is in liquid state. Fuel is vaporized in the container and exits the container through an outlet valve. Then, the fuel flows into the torch through a control valve or regulator. The amount of fuel flowing into the torch depends, not only on the flow passage opening provided by the valve, but also, on the internal pressure of the container. That pressure is a direct function of the ambient temperature. As a result, in the absence of some means to regulate the flow of fuel, large swings in ambient temperature greatly affect the amount of fuel flowing into the torch which is designed to operate at room temperature. When such a torch is operating under sub-freezing temperatures, the flame of the torch becomes very small and essentially useless. Alternatively, when the ambient temperature is very high, i.e. when the torch is used in the summer or in a hot environment, the flame becomes so large so as to be unmanageable.

In the past, torches have been developed to overcome this problem by utilizing different orifice sizes for different ambient temperatures or by utilizing diaphragms which are exposed to and respond to fuel pressure variations. Examples of valves utilizing diaphragms to maintain a constant flow when the internal pressure of the fuel source varies are disclosed in U.S. Pat. Nos. 3,475,110; 3,736,093; 3,978,880; and 3,865,137.

Another problem encountered in torches is that, although fuel is primarily vaporized in the fuel source, oftentimes, fuel exits the fuel source and enters the torch in the liquid phase. That problem is more common in portable torches which are sometimes turned upside down in order to direct the flames against a horizontal surface. When fuel enters the torch in the liquid phase, it produces a large yellow flame rather than the more desirable blue flame because the air/fuel mixture is not sufficient for such flame. In order to solve that problem, the prior art has attempted to increase the number of pressure drop points in the flow passage between the pressurized fuel source and the torch to increase the number of vaporization stages thereby decreasing the likelihood of liquid fuel entering the torch.

One disadvantage of the prior art torches that have attempted to solve the above problems is that, due to the inclusion of diaphragms and multi-stage pressure drop points, they are complex, bulky, expensive and, oftentimes, subject to failure due to such complexity. This disadvantage is overcome by the present invention which discloses a simple valve for regulating the flow of fuel from a pressurized fuel source to a torch which is simple, reliable, and inexpensive and which may be utilized in both cold or hot environments to give a desirable torch flame. The valve adjusts the flow of fuel passing therethrough automatically in response to the pressure in the fuel source and in the valve downstream over a wide range of operating temperatures and requires minimum manual adjustment during its operation. Furthermore, the valve vaporizes liquid fuel that may flow from the fuel source to the valve.

These and other objects and advantages of the present invention will become readily apparent from the following description.

SUMMARY OF THE INVENTION

The present invention discloses a valve or regulator for regulating the flow of fuel from a pressurized fuel source to a torch. The valve includes a valve body having an inlet and an outlet, a flow passage therethrough for providing fluid communication between the inlet and the outlet, and a flow regulating assembly for opening and closing the flow passage and for regulating the flow of fuel therethrough. The inlet has a threaded bore and a pusher pin for connecting the valve to an outlet valve of the fuel source to allow the flow of vaporized fuel from the fuel source to the flow passage of the regulator valve. The outlet includes a chamber and an orifice mounted in an orifice holder for attaching the regulator valve to a torch and for providing fluid communication between the flow passage of the regulator valve and the torch.

The flow regulating assembly is comprised of a needle body having an axial and longitudinal housing therein for housing a pin and cup assembly and a compression spring. The pin and cup assembly includes an elongate pin, a radial flange or cup extending from such pin and a resilient element abutting the front face of the cap. The spring is disposed around the pin and abuts on one end, the rear end of the cup and on the other end, the bottom of the housing. The spring biases pin and cup assembly away from the bottom of the housing and against a valve seat in the valve body. The needle body may be manually advanced or retracted in the body of the valve to a closed position and an opened position by turning the needle body in a threaded connection between the needle body and a retaining nut which is threaded into the valve body. When the needle body is advanced, the spring is compressed and the biasing force thereof on the pin and cup assembly is increased. When the needle body is retracted, the compression of the spring is decreased whereby the biasing force thereof on the pin and cup assembly is decreased.

In the closed position, the needle body abuts the interior surface of the flow passage of the valve to form a metal to metal seal therebetween to block the flow of fuel therethrough and to form the primary shutoff. Furthermore, the resilient element abuts the interior surface of the flow passage of the valve and further blocks the flow of fuel therethrough to form the secondary shutoff. In the opened position, the needle body is retracted to discontinue the metal to metal engagement between the needle body and the interior surface of the flow passage and the compression of the spring on the resilient element is decreased to allow the flow of fuel through the passage of the valve. The pin and cup assembly, and more particularly the resilient element, automatically regulates the flow in response to the pressure of the fuel in the flow passage upstream of the gasket the pressure of the fuel in the flow passage downstream of the gasket, and the force from the spring.

The torch includes a burner tube having a venturi and a flame holder, a piezoelectric igniter for igniting the fuel in the torch and a housing for attaching the igniter to the burner tube.

BRIEF DESCRIPTION OF THE DRAWINGS

For a detailed description of the embodiments of the apparatus of the present invention, reference will now be made to the accompanying drawings wherein.

DESCRIPTION OF THE PREFERRED EMBODIMENT

According to the present invention, a self-adjusting valve is disclosed for regulating the flow of fuel from a pressurized fuel source to a torch. The inlet and the outlet of the valve include couplings for connecting the valve to the fuel source and to the torch, respectively, a flow passage providing fluid communication between the inlet and the outlet, and a flow regulating assembly for closing and opening the flow passage and for regulating the amount of fuel flowing from the fuel source to the torch. In the opened position, the flow regulating assembly is self adjusting to regulate the fuel flow in response to pressure changes in the fuel source and in the valve downstream of the flow regulating assembly.

Figures 1, 5:
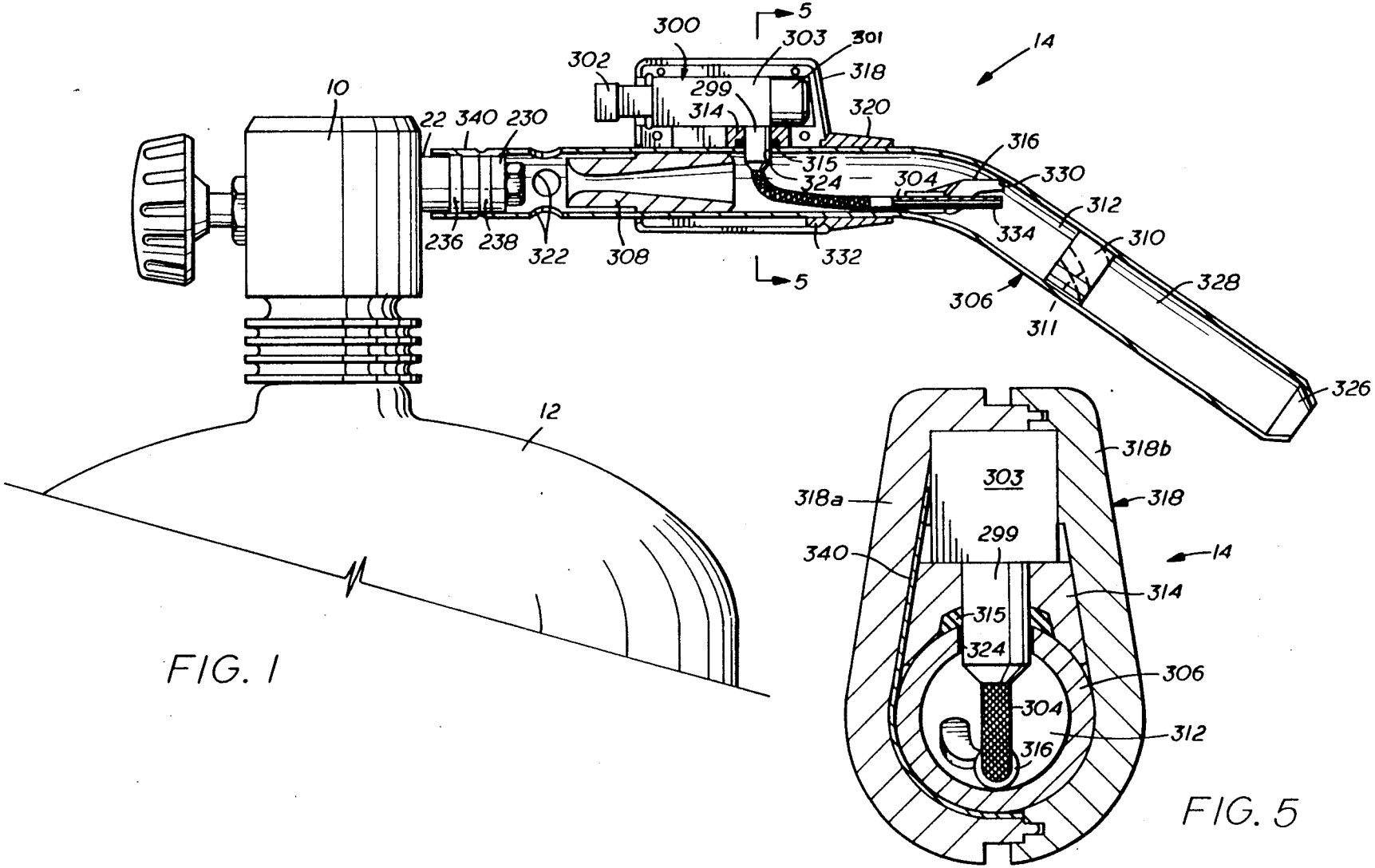
FIG. 1 is a fragmentary, partly cross-sectional, partly elevational view of an assembly comprised of a fuel cylinder, a valve and a torch made in accordance with the present invention.
FIG. 5 is a partly cross-sectional, partly elevational view of the torch of FIG. 1 taken along line 5—5 of FIG. 1.

Referring now to FIG. 1, there is shown a valve 10 being connected to a fuel bottle or canister 12, on one end, and to a torch 14, on the other end. Canister 12 contains fuel under pressure in the liquid state. Valve 10 controls and regulates the flow of fuel from canister 12 to torch 14. The fuel is any typical fuel used as industrial brazing, soldering, heating, cutting or welding fuel such as propane, butane, propylene, methylacetylene, propadiene or stabilized mixtures thereof.

Figure 2:
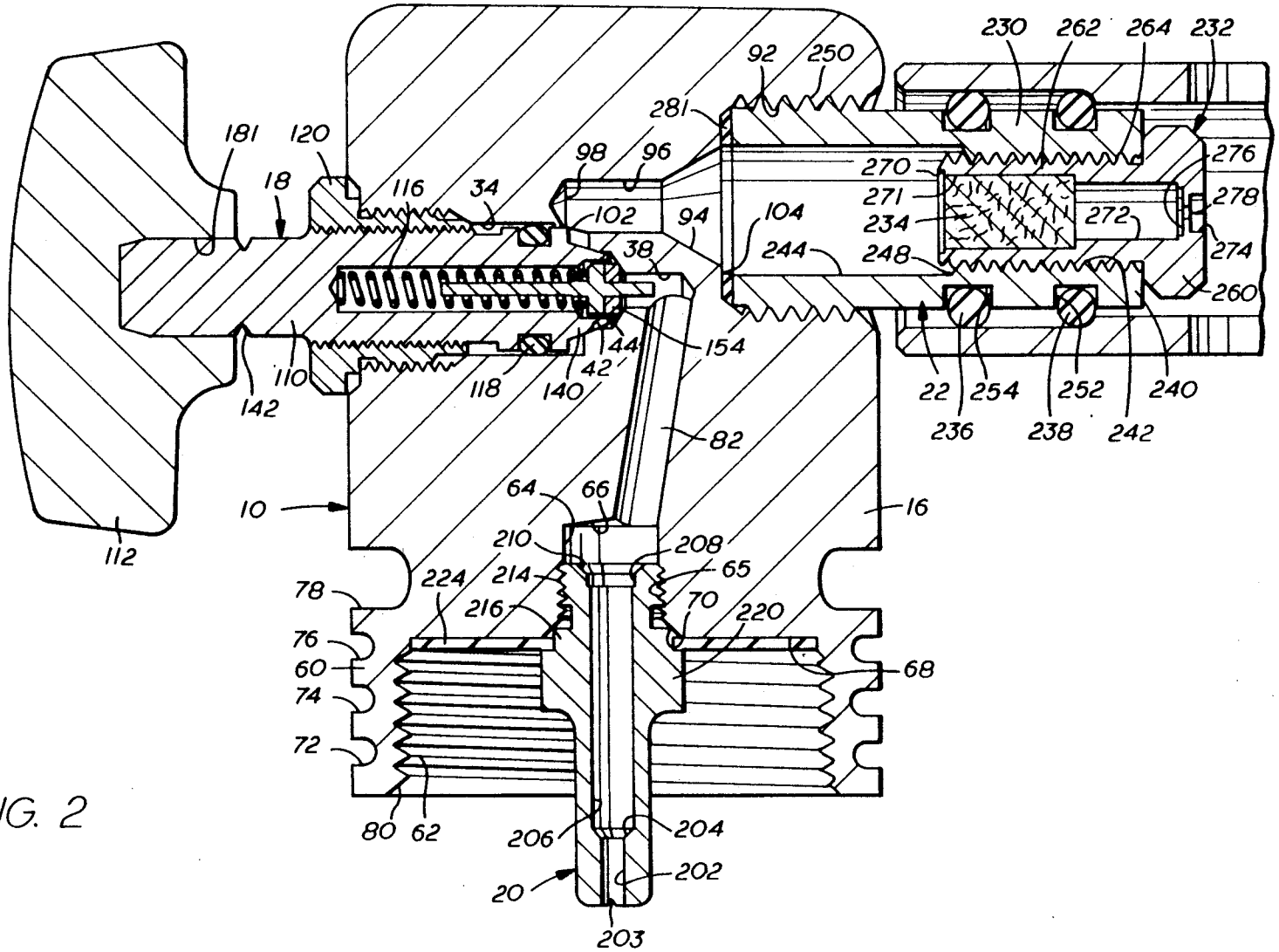
FIG. 2 is a fragmentary, cross-sectional view of the valve of FIG. 1 in the closed position being connected to the torch of FIG. 1.

Referring now to FIG. 2, there is shown an axial cross-section of valve 10. Valve 10 includes a generally cylindrical valve body 16, a flow regulating assembly 18, a canister coupling means or pusher pin 20 and a torch coupling means 22.

Figure 4:
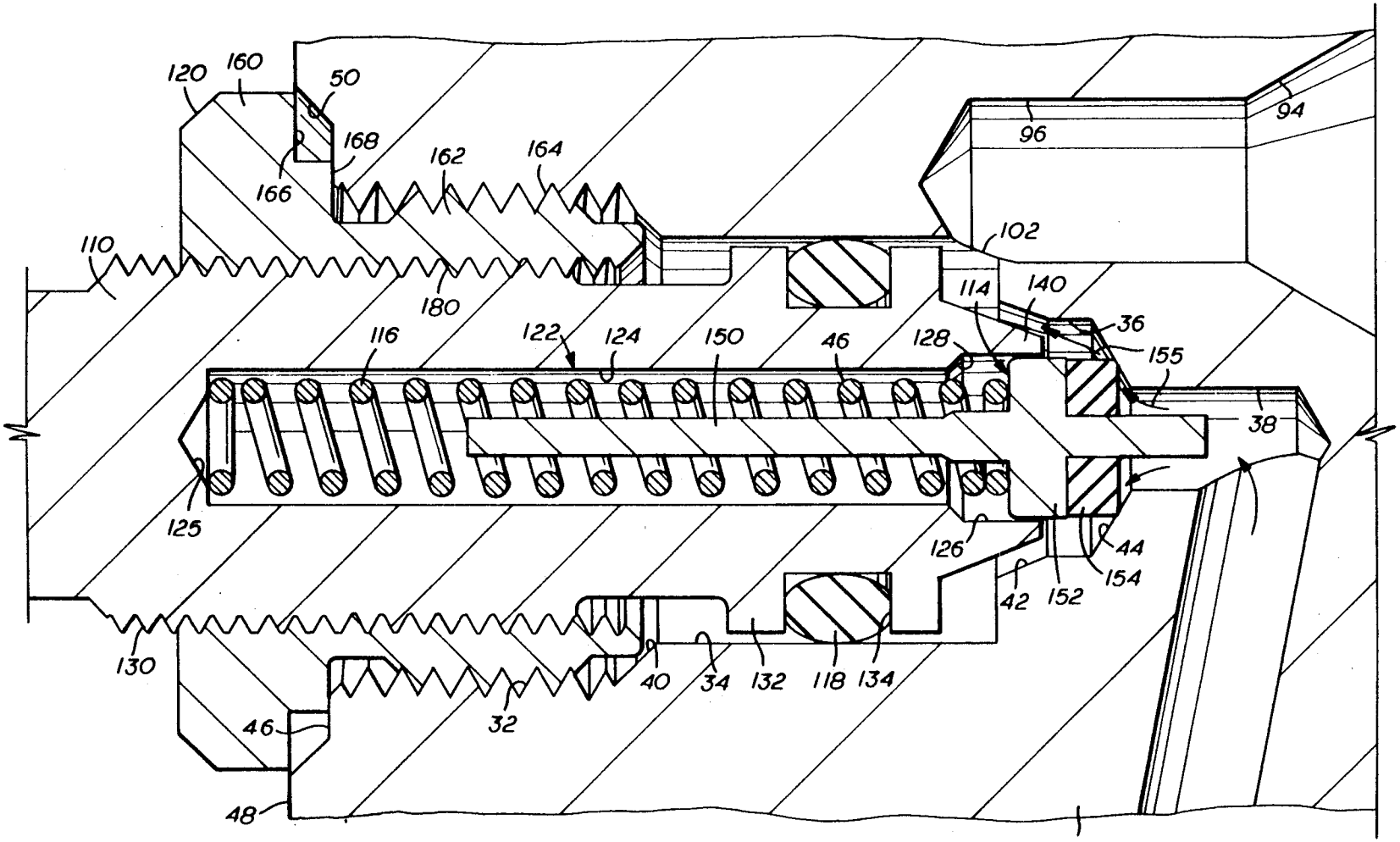
FIG. 4 is an enlarged fragmentary, cross-sectional view of the valve of FIG. 2 shown in an open position following manual activation of the valve.

Valve body 16 includes a radial cavity extending from the exterior surface of valve body 16 to the interior thereof for receiving flow regulating assembly 18. The cavity is now described by referring to both FIGS. 2 and 4. FIG. 4 shows an enlargement of a portion of valve body 16. The cavity is comprised of a series of coaxial bores, namely outer threaded bore 32, reduced diameter bore 34, further reduced diameter bore 36 and still further reduced diameter, partially blind, bore 38. Bore 34 is connected by chamfer 40 to threaded bore 32, bore 36 is connected by chamfer 42 to bore 34, and bore 38 is connected by chamfer 44 to bore 36. The outer end of bore 32 is counterbored at 46 with respect to exterior surface 48 of valve body 16, the counterbore including a conical surface 50.

Referring now again to FIG. 2 only, valve body 16 also includes a coupling collar 60 for coupling valve body 16 to canister 12 (not shown in FIG. 2). Coupling collar 60 includes a threaded axial bore 62 having a chamfered outer end 80, and a reduced diameter coaxial, partially blind, bore 64. Bore 64 is partially threaded with threads 65 and has a slightly conical bottom 66. Bore 64 is connected to bore 38 via passage 82. A shoulder 68 having a tapered end 70 is formed by the reduction in diameter from bore 62 to bore 64. The exterior surface of coupling collar 60 includes three substantially similar and parallel circumferential grooves 72, 74 and 76 and a circumferential groove 78 which is parallel to, but larger than, grooves 72, 74, and 76.

Valve body 16 further includes another radial cavity for receiving torch coupling means 22 and for providing fluid communication between torch coupling means 22 and bore 38 when valve 10 is in an open position to flow fuel from canister 12 to torch 14, as hereinafter described. The cavity includes a threaded radial bore 92, a tapered radial flow passage 94 which is coaxial to and connected in series with bore 92, and a partially blind flow passage 96 which is coaxial to and connected in series with flow passage 94. Flow passage 96 has a slightly conical bottom 98 and intersects bore 34 at point 102 whereby there is fluid communication between bore 34 and cylindrical flow passage 96. The transition from bore 92 to tapered flow passage 94 forms a shoulder 104.

Referring now again to both FIGS. 2 and 4, flow regulating assembly 18 includes a generally cylindrical needle body 110, a knob 112, a retaining nut 120, a pin and cup assembly 114, a compression spring 116, and an O-ring 118. Needle body 110 has a cylindrical housing 122 that extends from the inner end of needle body 110 to the interior thereof for receiving pin and cup assembly 114, and spring 116, as hereinafter described. Housing 122 includes an interior blind bore 124 having a partially conical bottom 125, and a counterbore 126. A tapered shoulder 128 is formed at the transition from bore 126 to bore 124. Needle body 110 further includes exterior longitudinal splines (not shown) on the outer exterior surface thereof for engaging cooperating splines in knob 112, a circumferential recess 142 adjacent thereto, exterior threads 130 on the middle portion of its exterior surface, and upper and lower flanges 132 and 134 that form a circumferential groove therebetween for receiving O-ring 118. The exterior surface of needle body 110 is tapered at inner end 140.

Pin and cup assembly 114 includes an elongate pin 150, a radial flange 152 extending from the exterior surface thereof, and a resilient gasket 154 being disposed over the inner end of pin 150 and engaging the inner face of flange 152. The materials of construction of pin and cup assembly 114 must be compatible with the fuel being regulated by valve 10, whether such fuel is in liquid or gaseous state. An example of pin and cup assembly 114 that can be utilized in connection with a valve 10 regulating the flow of fuel to a torch 14 is a Schrader pin and cup assembly part number 1160-16.

The dimensions and compression characteristics of spring 116 depend on the application of valve 10. In a typical application of a valve 10 regulating the flow of fuel from cannister 12 to torch 14, as described above, a spring manufactured by Scovill/Schraeder Division (Part Number 6186-5) may be used. That particular spring is constructed of music wire having 0.027 in diameter. The wire is coated with phosphate (National Standard Tru-Coat or equivalent). Furthermore, that spring has an outside diameter of about 0.13 inches, a free length of about 0.705 inches and a spring constant of about 51.1 pounds per inch.

Retaining nut 120 includes a generally hexagonal head 160 and a pin end 162 having exterior threads 164. Head 160 includes a reduced portion that forms shoulders 166 and 168. Retaining nut 120 also includes a threaded axial bore 180.

In the assembled position, retaining nut 120 is threadingly disposed over needle body 110 for a threaded connection between threads 130 and threaded axial bore 180. Knob 112 is received over needle body 110 for a secure connection therebetween provided by conventional splines (not shown) on needle body 110 and corresponding splines (not shown) on the interior surface of bore 181 of knob 112. Spring 116 is received over the outer portion of pin 150, and spring 116 and pin and cup assembly 114 are inserted into housing 122 until the outer end of spring 116 abuts bottom 125 of bore 124. The interior diameter of bore 126 and the exterior diameter of flange 152 are appropriately sized to allow a loose fit therebetween and a free axial movement of flange 152 in bore 126.

Prior to assembly, a thread lubricant is dispersed on the threads of threaded bore 180 and on threads 130. The preferred lubricant is comprised of one part (weight) of molybdenum disulfide powder thoroughly blended into seven parts (weight) of solvent resistant grease. Both components are sometimes supplies by Tower Oil Company of Chicago, Ill. The same lubricant is also placed on the exterior surface of tapered end 140 and on chamfer 42.

The assembly comprised of retaining nut 120, needle body 110, spring 116, and pin and cup assembly 114 is inserted in the cavity of valve body 16 that includes bores 32, 34, 36 and 38 by threadingly engaging threads 164 of retaining nut 120 with the threads of threaded bore 32 and by advancing nut 120 into threaded bore 32 until shoulder 168 of head 160 abuts valve body 16 at 46. In that position, needle body 110 may be manually advanced into retaining nut 120 and valve body 16 by turning knob 112 clockwise until the exterior surface of tapered end 14 which is parallel to chamfer 42 abuts chamfer 42 of bore 34 to form a metal to metal seal therebetween. In that position, gasket 154 is compressed against chamfer 44 by spring 116. The metal to metal seal between the exterior surface of tapered end 140 of needle body 110 and chamfer 42 form the primary shut-off and the compressed gasket 154 against chamfer 44 forms the secondary shut off to fully close valve 10 and to prevent the flow of fluid therethrough. FIG. 2 shows that fully closed position.

Figure 3:
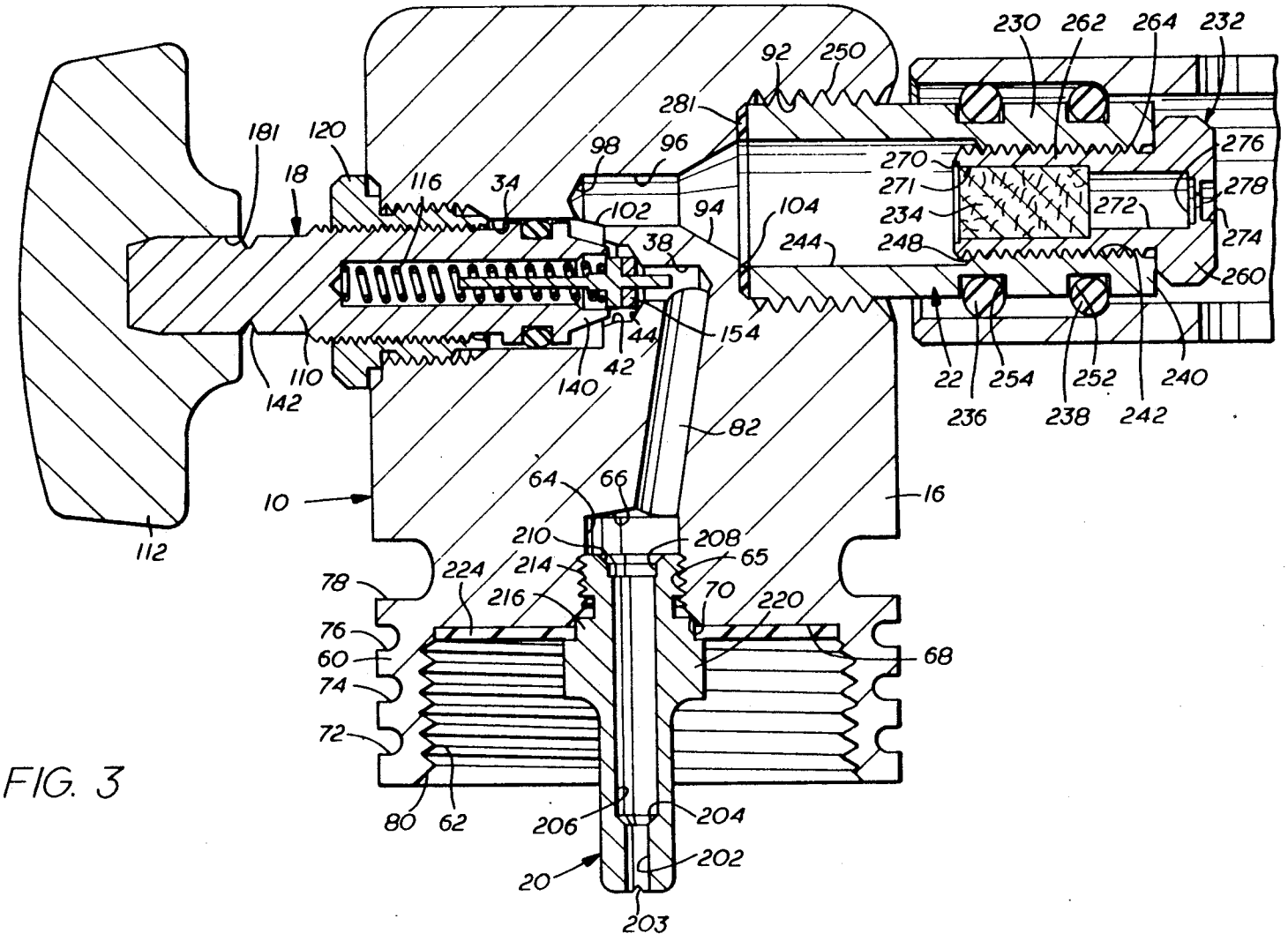
FIG. 3 is a fragmentary, cross-sectional view of the valve and the torch of FIG. 2 wherein the valve is in an open position following manual activation of the valve.

Similarly, needle body 110 may be manually retracted by turning knob 112 counterclockwise to disengage tapered end 140 of needle body 110 from chamfer 42 and to partially relax the compression of spring 116 thereby decreasing the biasing force of spring 116 on gasket 154 and the compression of gasket 154. FIG. 3 shows valve 10 of FIG. 2 in an opened position. Fuel flows around resilient gasket 154 through valve 10. FIG. 4 also shows needle body 110 in a retracted position with the compression on gasket 154 by spring 116 partially relaxed to open valve 10 and to allow fuel flow therethrough as shown by arrows 155. At the position shown in FIGS. 3 and 4, valve 10 automatically adjusts itself, as described hereinafter. It should be understood that, although FIGS. 3 and 4 do not show a visible gap between gasket 154 and chamfer 44, there is a sufficient opening provided between relaxed gasket 154 and chamfer 44 to allow the flow of fuel therebetween.

Referring now again to FIG. 2, pusher pin 20 has an elongate, generally tubular, body having an axial flow passage therethrough and a diametrical groove 203 across the inlet end. The axial flow passage includes an inlet bore 202, a tapered transition flow portion 204, an increased diameter middle bore 206, a further increased diameter bore 208, and a tapered exit 210. The exterior surface of pusher pin 20 includes an exterior threaded surface, on the exit end, having threads 214, a flange 216, and an enlarged middle portion or flange 220 having a generally hexagonal exterior surface for gripping and rotating pusher pin 20 by appropriate means.

A circular gasket 224 is received over flange 216. Pusher pin 20 is threaded into bore 64 by engaging threads 214 and threads 65, until flange 216 abuts the surface of tapered end 70 of shoulder 68 and forms a metal to metal seal therebetween. The interior circular portion of gasket 224 is compressed by flange 220 against shoulder 68.

Referring now to both FIGS. 1 and 2, valve 10 is connected to canister 12 by engaging threaded bore 62 with compatible threads on the exterior surface of a standard canister valve outlet (not shown). An example of such outlet valve is a Compressed Gas Association 600 Fuel Outlet. Pusher pin 20 engages the standard canister valve outlet and automatically opens the same thereby releasing vaporized fuel into flow passage 82 via the axial flow passage defined by bore 202, flow portion 204, bores 206 and 208, and flow portion 210 in pusher pin 20, and via bore 64.

Referring now again only to FIG. 2, torch coupling means 22 includes an orifice holder 230, an orifice nut 232, a filter 234, and O-rings 236 and 238. Orifice holder 230 is a generally tubular member having a threaded box end 240 with interior threads 242, and an increased diameter inlet bore 244 being coaxially connected to the threaded bore of box end 240 by tapered flow portion 248. The exterior surface of orifice holder 230 includes exterior threads 250, and circumferential grooves 252 and 254 for receiving O-rings 238 and 236, respectively.

Orifice nut 232 includes a hexagonal head 260, and a pin end 262 having an exterior threaded surface 264. Orifice nut 232 further includes a flow passage therethrough comprised of an inlet flow portion 270, a reduced diameter filter housing 271, a further reduced diameter middle flow portion 272, and a further reduced diameter outlet flow portion 274. Outlet flow portion 274 includes a flow restriction element 276 having a pin hole 278 therethrough.

Filter 234 is slidingly inserted and staked into filter housing 271 for a snug fit therein. Pin end 262 of orifice nut 232 is threaded into threaded box 240 and head 260 abuts the end of orifice holder 230. A circular gasket 281 compatible with shoulder 104 is placed in the inner end of bore 92. A penetrating thread locking sealant is dispersed on the threads of bore 92 and on threads 250. The preferred sealant is Omni FIT 1710. Another sealant that may be used is Loctite 290. Orifice holder 230 is threaded into threaded bore 92 by engaging threads 250 and bore 92. The end of orifice holder 230 compresses gasket 281 against shoulder 104 for a sealing engagement therebetween.

Referring now again to FIG. 1, there is shown a partly cross-sectional, partly elevational, view of torch 14 connected to valve 10. Torch 14 is comprised of a bent burner tube 306; a venturi 308 and a flame holder 310 being mounted in burner tube 306 and forming a chamber 312 therebetween; a piezoelectric igniter 300 having an igniter switch 302, an igniter grounding plug 301, an igniter body 303, an igniter boot 299, and a conductive igniter wire 304 which is surrounded by insulating material; and means for attaching igniter 300 to burner tube 306 including a metallic igniter spacer 314, an O-ring 315, a spade terminal 316, a plastic case 318, and a plastic case finger guard 320.

Burner tube 306 has openings 322 for providing an inlet for air adjacent to the inlet of venturi 308, an aperture 324 providing an opening for inserting ignition wire 304 to chamber 312, and a tapered front end or tip 326. Flame chamber 328 is formed between flame holder 310 and tip 326 in burner tube 306. Flame holder 310 has a generally cylindrical body with a series of external helical grooves 311 thereon to maintain the flame in flame chamber 328. An example of such flame holder is Flame Holder Number 5 manufactured by Dixon Sintaloy, Inc. (Number S-1628).

Igniter spacer 314 and O-ring 315 are received over igniter boot 299 and spade terminal 316 is received over igniter wire 304. A portion of igniter boot 299 and igniter wire 304 extending from igniter boot 299 are then inserted into ignition chamber 312 via aperture 324. The tip end of spade terminal 316 engages the inner surface of burner tube 306 at point 330. Igniter spacer 314 abuts igniter body 303, igniter grounding plug 301, and the surface of burner tube 306, and provides conduction between igniter grounding plug 301 and burner tube 306. O-ring 315 seals the surfaces between igniter boot 299, igniter spacer 314 and burner tube 306 to prevent the escape of fluids from chamber 312. Case finger guard 320, which has a generally tubular body with an exterior tapered surface and a semi-circular lip 332 extending therefrom, is received over burner tube 306. Case 318 which is comprised of two symmetrical half portions (not shown in FIG. 1 but shown in FIG. 5) encloses igniter body 303, igniter spacer 314 and a portion of burner tube 306. The two half portions are connected to lip 332 of case finger guard 320 by a "bayonet type" slot connection. The two half portions are also securely attached to each other by rivet or similar means (not shown).

Referring now to FIG. 5, there is shown a partly cross-sectional, partly elevational view of torch 14 along line 5—5 of FIG. 1. FIG. 5 shows an elevational view of igniter body 303, igniter boot 299, and igniter wire 304. There is shown igniter spacer 314 and O-ring 315 being received over igniter boot 299 with a portion of igniter boot 299 and igniter wire 304 extending into chamber 312 through aperture 324. Spade terminal 316 is disposed over wire 304. Case 318, which is comprised of two symmetrical half portions 318*a* and 318*b* provides an enclosure for igniter body 303, igniter spacer 314, igniter boot 299, and a portion of burner tube 306. A metallic conductive sheet 340, preferably constructed of soft tempered copper alloy material, is disposed in the interior surface of half portion 318*a* and provides conduction between igniter body 303 and burner tube 306.

Referring back to FIG. 1, piezoelectric igniter 300 is well known in the art and includes components so as to generate a spark piezoelectrically. An example of such igniter is Panasonic EFI-ML 25. Igniter 300 is activated by pushing switch 302 to generate a spark at tip 334 of igniter wire 304. Spade terminal 316 positions tip 334 of igniter wire 304 so that the distance of tip 334 from the interior surface of burner tube 306 is sufficient to generate a strong spark therebetween to ignite torch 14 when fuel flows in chamber 312.

Torch 14 is connected to valve 10 by receiving coupling end 340 of torch 14 over torch coupling means 22, and more particularly, over orifice holder 230 and O-rings 236 and 238. The internal diameter of coupling end 340 is compatible with the external diameter of orifice holder 230 whereby the resilient O-rings 236 and 238 securely retain torch 14 thereon and provide a seal between the interior surface of burner tube 306 and the exterior surface of orifice holder 230 to prevent the escape of fuel therebetween.

Referring now to both FIGS. 1 and 2, torch 14 is placed into operation by connecting valve 10 to canister 12 and opening the canister outlet valve (not shown) with pusher pin 20, as previously described. Vaporized fuel flows through the axial flow passage of pusher pin 20 and bore 64 to passage 82 and bore 38. When valve 10 is fully closed as shown in FIG. 2, i.e. when tapered end 140 of needle body 110 abuts chamfer 42 an gasket 154 sealingly engages chamfer 44, fuel gas is prevented from flowing past bore 38. Referring now to both FIGS. 3 and 4, valve 10 is manually opened by turning knob 112 counterclockwise whereby needle body 110 is retracted to disengage chamfer 42 and to reduce the compression of gasket 15 on chamfer 44. Fuel gas flows around resilient gasket 154 and needle body 110 into bores 36 and 34. Fuel gas then flows through intersecting point 102 to bores 96, flow passage 94, bore 244, inlet flow portion 270, filter 234, flow portion 271, pin hole 278, and the inlet of burner tube 306.

Referring now to FIG. 1, upon entering burner tube 306, the fuel gas is mixed with air flowing into burner tube 306 via openings 322 and the mixture is drawn into chamber 312 by venturi 308. The fuel gas is ignited in chamber 312 by initiating a spark through igniter 300 at tip 334 of igniter wire 304. Once the fuel is ignited, flame holder 310 retains the flame in flame chamber 328 and provides a flame exiting through tip 326.

Referring now to FIGS. 3 and 4 showing valve 10 in an open position, pin and cup assembly 114 is subjected to a force applied thereon by the pressure of the fuel gas in bore 38, upstream of gasket 154, and to counteracting forces applied by compressed spring 116 and by the pressure of the fuel gas downstream of gasket 154. Pin and cup assembly 114 is responsive to the change in the magnitude of these forces and is allowed to move longitudinally to adjust the compression on gasket 154 which engages chamfer 44. The magnitude of the compression on gasket 154 affects the pressure drop of the fuel and the amount of flow of such fuel flowing past gasket 154. For example, when the pressure of the fuel gas downstream of gasket 154 decreases because a small amount of fuel flows around gasket 154 and fuel gas does not accumulate in bore 96, pin and cup assembly 114 automatically moves towards shoulder 128 to decrease the compression on gasket 154 and to increase the flow of fuel around gasket 154 without manual adjustment. Similarly, if the pressure downstream of gasket 154 increases because fuel gas accumulates in bore 96, pin and cup assembly 114 moves automatically towards chamfer 44 to increase the compression on gasket 154 and to reduce the amount of fuel gas flowing around gasket 154 through valve 10.

Unlike the valves of the prior art, valve 10 can be used over a wide range of internal pressures of canister 12 and over a wide range of ambient temperatures without requiring modifications or without utilizing complex diaphragms or other components. This is accomplished by manually adjusting the length of retraction of needle body 110 to adjust the compression of spring 116 and the biasing force being exerted by spring 116 on pin and cup assembly 114 and on gasket 154 in the open position. The length of retraction is an inverse function of the magnitude of the internal pressure of canister 12. When the internal pressure of canister 12 is high the length of retraction of needle body 110 is smaller than the length of retraction required when the internal pressure of canister 12 is low. Accordingly, in the former case, spring 116 is compressed more to exert a larger biasing force on pin and cup assembly 114 to counteract the larger pressure upstream of gasket 154.

It becomes apparent from the above description, that once the position of needle body 110 is manually adjusted by rotation of knob 112 to a position wherein a desirable flame is generated by torch 14 for the particular canister pressure, valve 10 automatically adjusts the flow of fuel automatically in response to the pressure of the fuel upstream and downstream of gasket 154. No further adjustment is necessary unless the pressure of the fuel in canister 14 decreases or increases drastically.

Because of the unique construction of valve 10 of the present invention, any fuel that enters valve 10 in the liquid state is vaporized when it passes around gasket 154. Furthermore, if liquid fuel flows past gasket 154, the vaporization of such liquid downstream of gasket 154 causes an increase in the downstream pressure whereby pin and cup assembly 114 moves towards chamfer 44 to increase the compression of gasket 154 and to automatically decrease the flow of fuel passing around gasket 154.

Although valve 10 and the components thereof may be constructed of any well known construction material, valve body 16, flow regulating assembly 18, canister coupling means 20, and torch coupling means 22 are preferably constructed of metallic material except for knob 112 which is constructed of plastic material, and gaskets 154, 224 and 281, and O-rings 118, 236 and 238 which are constructed of well known resilient material.

It should be understood, that although valve 10 of the present invention is primarily described in connection with brazing, soldering, heating, cutting or welding torches utilizing industrial cutting fuel such as propane, butane, etc., supplied in a pressurized bottle or canister 12, valve 10 may be utilized in connection with other applications wherein it may be used as a valve regulating the flow from a fuel source containing fuel under pressure to a fuel utilization or burning device. Furthermore, it should be understood that although valve 10 has been described in connection with a specific torch 14, a specific torch coupling means 22, a specific cylindrical canister, and a specific canister coupling means 20, valve 10 of the present invention may be utilized with other torches, torch coupling means, pressurized fuel sources, or fuel source coupling means without departing from the spirit of the invention.

While preferred embodiments of the valve and the torch of the present invention have been described, modifications thereof can be made by one skilled in the art without departing from the spirit of the invention.

What is claimed is:

1. A housing for housing an igniter and for attaching the igniter to a burner tube of a torch, comprising:

a first case portion having a projection;

a second case portion;

a tubular body being receivable over the burner tube;

a lip extending from the tubular body and having a slot for receiving the projection to connect the lip to the first case portion; and means for connecting the first case portion to the second case portion.

2. A torch, comprising:

a burner tube having a chamber and an aperture;

an igniter mounted on the burner tube, the igniter having a switch, an igniter body, an igniter boot and an igniter wire, the igniter boot and the igniter wire extending into the chamber through the aperture;

an igniter spacer positioned between the igniter body and the burner tube; and a case enclosing the igniter body, the igniter spacer and a portion of the turner tube, the case including:

a first case portion;

a second case portion; and means for connecting the first case portion to the second case portion wherein the connecting means includes a tubular body being received over the burner tube and a lip extending from the tubular body and having a groove which is engageable by projections extending from the first case portion and the second case portion.

* * * * *